US005516415A

United States Patent [19]

Palumbo et al.

[11] Patent Number: 5,516,415

[45] Date of Patent: May 14, 1996

[54] PROCESS AND APPARATUS FOR IN SITU ELECTROFORMING A STRUCTURAL LAYER OF METAL BONDED TO AN INTERNAL WALL OF A METAL TUBE

[75] Inventors: Gino Palumbo, Etobicoke; Philip C. Lichtenberger, Burlington; Francisco Gonzalez, Toronto; Alexander M. Brennenstuhl, Mississauga, all of Canada

[73] Assignee: Ontario Hydro, Toronto, Canada

[21] Appl. No.: 152,714

[22] Filed: Nov. 16, 1993

[51] Int. Cl.[6] ..... C25D 1/02

[52] U.S. Cl. ..... 205/73; 205/115; 205/131

[58] Field of Search ..... 205/131, 115, 205/151, 73; 204/272, 260

[56] References Cited

U.S. PATENT DOCUMENTS

| | | | |
|---|---|---|---|
| 3,287,248 | 11/1966 | Brathwaite | 204/262 |
| 4,080,268 | 3/1978 | Suzuki et al. | 205/131 |
| 4,120,994 | 10/1978 | Inoue | 427/239 |
| 4,200,674 | 4/1980 | Inoue | 427/290 |
| 4,280,882 | 7/1981 | Hovey | 205/50 |
| 4,624,750 | 11/1986 | Malagola | 205/131 |
| 4,687,562 | 8/1987 | Smith et al. | 204/206 |
| 4,696,723 | 9/1987 | Bosquet et al. | 205/115 |
| 4,826,582 | 5/1989 | Lavalerie | 204/196 |

OTHER PUBLICATIONS

Grain Boundary Design and Control For Intergranular Stress–Corrosion Resistance, G. Palumbo et al., Scripta Metallurgica et Materialia, vol. 25, pp. 1775–1780, 1991.

Deviations From Hall–Petch Behaviour in As–Prepared Nanocrystalline Nickel, A. M. El–Sherik et al., Scripta Metallurgia et Materialia, vol. 27, pp. 1185–1188, 1992.

*Primary Examiner*—John Niebling
*Assistant Examiner*—Brendan Mee
*Attorney, Agent, or Firm*—Ridout & Maybee

[57] ABSTRACT

A process for repairing degraded sections of metal tubes, such as heat exchanger tubes, by in situ electroforming utilized a flexible probe containing an electrode. The probe is movable through the tube to the site of degradation and is sealed in place, thereby creating an electrochemical cell. Electrolyte flows from a reservoir through the cell and a structural layer of metal is deposited on the tube using a pulsed direct current and a duty cycle of 10–40%. The metal layer so formed possesses an ultrafine grain size preferably with a highly twinned microcrystalline structure giving the layer excellent mechanical properties.

22 Claims, 3 Drawing Sheets

PROCESS AND APPARATUS FOR IN SITU ELECTROFORMING A STRUCTURAL LAYER OF METAL BONDED TO AN INTERNAL WALL OF A METAL TUBE

The invention is a process for structurally reinforcing a tube by in situ electroforming. The process is particularly-useful for repairing heat exchanger tubes which have been degraded by such things as localized and general corrosion, stress or fatigue cracking. The process has particular application for the maintenance and repair of high temperature and pressure heat exchangers used in power generating facilities such as nuclear power plants.

While the skilled person will appreciate that the invention has general industrial utility, the process will be described with particular reference to heat exchanger tubing. In this regard, the maintenance of the structural integrity of heat exchanger tubes presents an ongoing industrial problem. Heat exchanger tube walls must be strong and corrosion resistant while also being as thin as possible to provide efficient heat transfer across the tube wall. Under certain environmental conditions, heat exchanger tubes deteriorate, but the deterioration may not occur uniformly. Rather, micro-cracks or other imperfections provide sites for localized tube degradation, which if repaired, can significantly extend the life of the entire tube.

When repairing a section of degraded tubing, it is essential to restore the wall to initial mechanical design specifications, e.g., burst pressure (hoop strength), bend strength, fatigue endurance and corrosion allowance. Currently, the common practice for tube repair involves inserting a tubular sleeve of appropriate dimensions and mechanical characteristics into the tube section requiring repair, and fixing the sleeve in place at its extremities by friction bonding, welding or brazing to the tube.

This sleeving technique suffers from several disadvantages. The degraded tube section requiring repair may not be a suitable candidate for sleeving due to its location or geometry. Sleeved tube sections do not perform to original heat transfer specifications due to the double wall effect and the reduced flow cross section of the sleeved tube portion.

While in situ electrodeposition of thin anticorrosion layers of metal has been known for some time, e.g., U.S. Pat. No. 4,624,750, the present invention provides an improved process which enables the electroforming of a structural layer of metal bonded to the internal wall of a degraded section of a metal tube. The electroforming conditions result in a metal layer possessing an ultrafine grain microstructure which may also possess a high degree of crystal lattice twinning between metal grains (i.e. "special" grain boundaries), thereby imparting a high degree of strength and corrosion resistance to the deposited layer while maintaining excellent ductility.

Accordingly, the invention provides a method for in situ electroforming a structural layer of metal bonded to an internal wall of a degraded section of a metal tube, comprising the steps of:

a) mechanically cleaning the internal tube wall surface in the tube section;

b) inserting a probe into the metal tube and moving it so that it spans the degraded tube section, the probe having an electrode extending substantially along its length, sealing means at each end for containment of fluids within the tube section, and circulation means for flowing fluids into and out of the tube section;

c) electrodepositing a strike layer of metal on the internal wall of the tube section by flowing an electrolyte containing at least one metal salt of interest through the section and applying a direct current between the electrode and the metal tube; and d) electroforming a structural layer of metal on the strike layer by flowing an electrolyte containing at least one metal salt of interest through the section and applying a pulsed direct current between the electrode and the metal tube at a frequency of 100 to 1000 Hz with a duty cycle in the range 10 to 40% to electroform a metal layer 0.1 to 2 mm thick.

The invention also includes a probe for carrying out the process of the invention. The probe of the invention is insertable into a metal tube to be repaired. Preferably, the metal tube has an internal diameter of at least 10 mm. The probe comprises sealing means located at each end of the probe for securing the probe in a section of the tube, thereby defining a cell, and for containing the flow of fluids within the tube section. A flexible electrode, such as a tubular structure formed from platinum wire, extends the length of the probe. A porous non-conductive, preferably plastic, tubular housing surrounds the electrode along its entire length. The probe has fluid circulating means which provide flow communication between the cell and an external fluid reservoir.

The present invention is intended for use in association with tubes made of any of the commercial iron, copper and nickel based alloys. The electroformed metal layer deposited according to the invention may comprise any commercial iron, nickel and chromium bearing alloy. Preferably, the internal diameter of the tube being repaired is at least 10 mm, and the length of tube section being repaired is in the range 150 mm to 900 mm. The following description illustrates the method of the invention as it relates to the deposition of nickel on the internal wall of a tube. The artisan will appreciate that the invention has a more general application than that specifically described herein.

Figure 1:
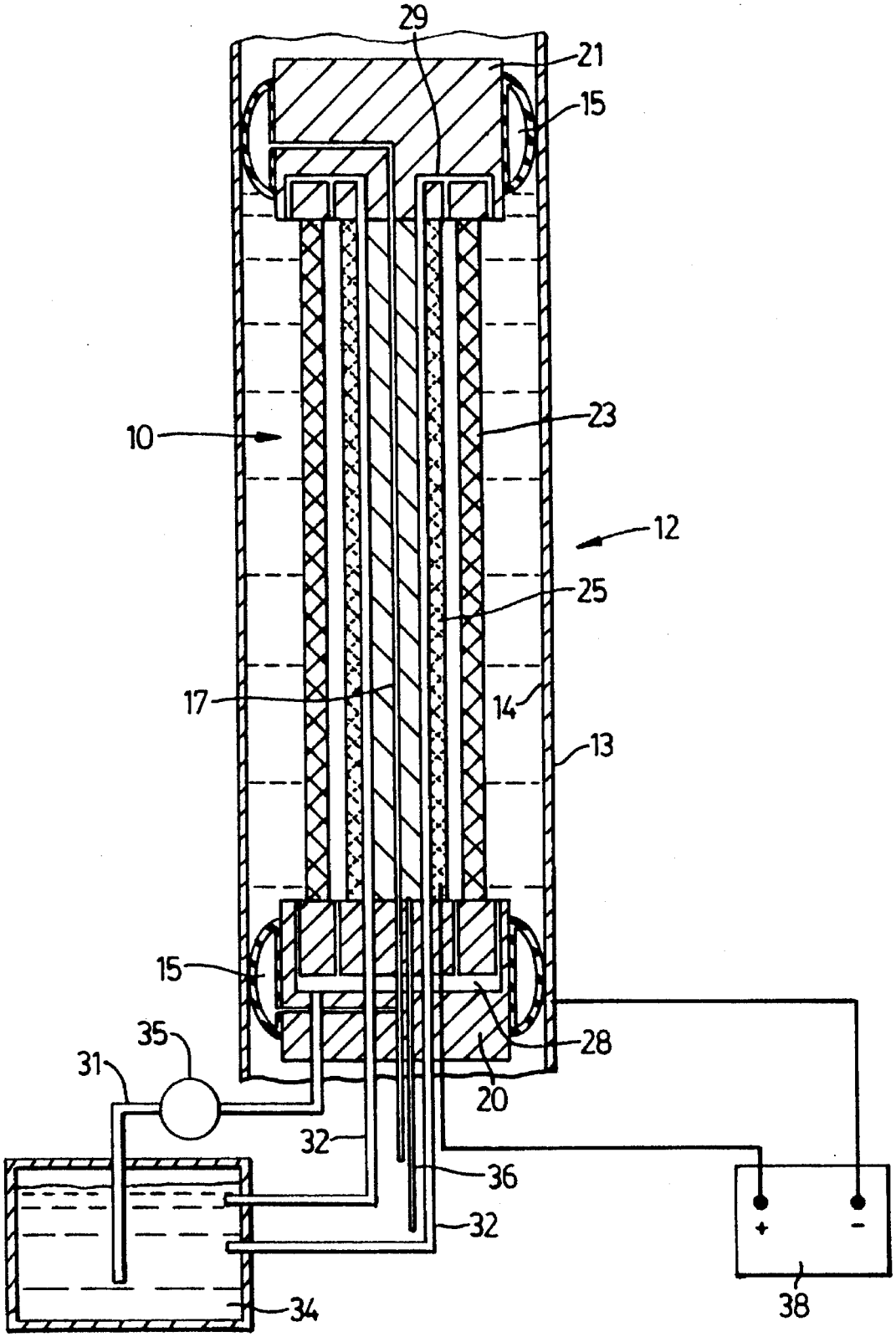
FIG. 1 is a cross sectional view of a probe for insertion into a tube having sealing means at each end, fluid circulation means and an electrode.

Referring to FIG. 1, a probe 10 is inserted into a metal tube 12, such as a nickel/copper alloy heat exchanger tube, and manipulated to a section 13 of the tube 12 requiring repair. The tube section 13 has an inner wall 14. The probe 10 has seals 15, which are preferably inflatable, at each end to isolate the probe 10 within the tube section 13 and to contain electrolyte and other process fluids within the section 13. The seals 15 are inflated through a capillary air line 17 connected to a pressurized air supply preferably in the range 10–40 psig. The seals 15 are provided about end base 20 and head 21 pieces which preferably are cylindrical in shape. An outer tubular porous plastic housing 23, which may be a plastic weave such as polypropylene, extends between the base 20 and head 21, and contains an electrode 25, which is the anode under electrodeposition conditions at the tube wall 14 and which preferably is a flexible porous tubular member made of woven Pt wire extending between the base 20 and head 21 of the probe 10. The flexible housing 23 provides an interface between the anode and cathode, i.e. the electrode 25 and tube 13; thus, preventing shorting during electrodeposition. The housing also hinders interference with the metal deposition at the tube wall 14 which may be caused by gases or sludge particles generated during electroforming. Fluids are circulated through the tube section 13 via a feed inlet means 28 and an outlet means 29 formed in the base 20 and head 21 respectively. Conduits 31 and 32 connect the inlet and outlet means 28 and 29 with a reservoir 34 and associated pump means 35. Preferably, a thermocouple 36 is provided through the base 20 to monitor the temperature during electroforming. The anode 25 and tube section 13 (cathode) are connected to a direct current power supply 38 by means of suitable conductor leads.

The air line 17, conduits 32, tubular anode 25, and tubular plastic housing 23 are all flexible to allow the probe 10 to be snaked through a tube 12 having curves or bends in it. Once the probe 10 is positioned at the desired location in the tube 12, pressurized air is provided through the line 17 thereby inflating the seals 15. Preferably, the seals 15 are toroidal rubber members which may be ribbed to provide a stronger grip against the inner tube wall 14. The skilled person will appreciate that other sealing means, such as thermally expandable O-rings, may be used to affect the same purpose as the inflatable seals 15 of the preferred embodiment. Also, different types of seals may be used at each end of the probe 10. In some applications, it may be useful to have an inflatable seal 15 at the base 20 with the seal at the other end of the probe 10 being effected by a separate removal plug (not shown).

Fluids may be delivered to and circulated through the seated probe 10 via the inlet and outlet means 28 and 29 with their associated conduits 31 and 32. The conduits 31 and 32 may be quite long (e.g., up to 500 ft.) depending on the application. While only one fluid reservoir 34 is shown in FIG. 1, clearly, a plurality of fluid reservoirs can be used with appropriate valving to supply and circulate the process fluids to and through the probe 10. The skilled person will understand that a preferred fluid delivery system for the probe 10 will include pumps, valves and programmable controlling and monitoring devices to provide fluid flows through the probe 10 under precise flow rate, pressure and temperatures conditions.

Preferably, the power supply 38 is a commercial pulse plating direct current unit having a 400 A/20 V peak output. Clearly, a busbar (not shown) may be used to connect a plurality of probes 10 which are inserted into a plurality of tubes 12.

A preferred process will now be described in relation to the electrodeposition of nickel on the wall 14 of a tube 12. The skilled person will appreciate that various metals or alloys can be electroformed on the tube wall 14 by using the appropriate metals or metal salts under the necessary electrochemical conditions. The chemistry of electroforming is well known. Typically, heat exchanger tubes such as used in power generating facilities are made of a nickel/copper alloy, so the electrodeposition of a nickel layer to repair a degraded tube section 13 of such a heat exchanger tube would in most instances be preferred.

The preferred process of the invention comprises initial surface preparation of the inner wall 14 of the tube section 13, the electrodeposition of a transition film of metal or a strike, and electroforming of the structural metal layer repairing the tube section 13.

The inner surface 14 of the degraded tube section 13 is mechanically cleaned by, for example, brushing or water lancing to remove any loose or semi-adherent deposits. The probe 10 is then inserted into the tube 12 and manipulated to span the degraded section 13. The probe 10 is secured in place in the tube 12 by inflating the seals 15 as described. The secured probe 10 and tube section 13 define an electrochemical cell.

The tube section 13 is degreased by circulating an aqueous solution of 5% NaOH through the probe 10 at a flow rate of 100–400 ml/min., preferably 300–400 ml/min. The flow of fluid through the probe 10 is via conduits 31 and 32 as described. A current density of 10–100 mA/cm$^2$ is applied between the anode 25 and cathode (tube section 13) for 5–10 min. to vigorously generate hydrogen gas at the inner tube wall surface 14, thereby removing all remaining soils and particulates from the tube surface 14. This degreasing step is followed by a rinsing flow of deionized water through the tube section 13 for about 5 min.

A dilute aqueous solution of strong mineral acid, e.g. 5% HCl, is circulated through the tube section 13 at a flow rate of 100–400 ml/min., preferably 300–400 ml/min., for 5–10 min. to reduce surface films on the inner wall 14 and to activate the wall surface 14 for electro-deposition. A solution of $NiCl_2$ (200–400 g/l) and boric acid (30–45 g/l) as a buffer in water at 60° C. is then circulated through the tube section 13 at a rate of 100–400 ml/min., preferably 300–400 ml/min. A direct current density of about 50 mA/cm$^2$ to about 150 mA/c$^2$ is applied across the electrodes for 2–15 min. to allow the deposition of a thin strike of nickel (<10 μm thick) on the inner tube wall 14. Preferably, the direct current is pulsed with an average current density of 50–150 mA/cm$^2$ at a frequency of 100–1000 Hz with an on-time or duty cycle of 10–40%. Chloride in the electrolyte acts to etch the wall surface 14, thereby assisting the formation of a strong bond between the wall 14 and strike layer.

A structural layer of fine grained nickel is then electroformed onto the strike by circulating through the tube section 13 an aqueous solution of $NiSO_4$ (300–450 g/l) or nickel sulfamate ($Ni(SO_3NH_2)_2$) (300–450 g/l) and boric acid (30–45 g/l), preferably with low concentrations of additives such as sodium lauryl sulfate (surfactant), coumarin (leveler), and saccharin (brightener) each having a concentration not exceeding 1 g/l, preferably 60 mg/l. Nickel cations are replenished in the electrolyte by the addition of $NiCO_3$.

As the skilled person will appreciate, these additives provide a better quality electroformed layer under most anticipated electroforming conditions. Thus, sodium lauryl sulfate acts to reduce the surface tension of the electrolyte, thereby reducing or eliminating pitting in the surface of the deposited layer. Coumarin acts as a leveler to assist the filling of micro-cracks in the electroforming layer. Saccharin acts to smooth out the surface of the metal layer during electroforming and reduces stresses in the deposit.

The electroforming solution is circulated at a temperature of 40°–60° C. to enhance reaction kinetics, and a pulsed average direct current density of 50–300 mA/cm$^2$ is applied across the electrodes 25 and 13. When electroforming with $NiSO_4$, the average direct current density is preferably 50–150 mA/cm$^2$, and with nickel sulfamate it is preferably 100–300 mA/cm$^2$. The pulsing of the current proceeds at a frequency of 100–1000 Hz with the on-time or duty cycle being 10–40%. In many cases, it is advantageous to provide periodic reverses in the polarity of the applied current. The periodic reversal of polarity serves to reverse the electroforming process momentarily. This reversal occurs preferentially at high spots or thicker areas of the deposited layer, thereby tending to encourage the production of a uniform layer thickness. Also, reversing the polarity reactivates the metal surface making it more receptive to further electroforming. The polarity reversal is carried out periodically at a lower current density than used for electroforming. The amount of polarity reversal optimally does not exceed about 10% of the total duty cycle. Electroforming proceeds for sufficient time to allow the formation of a structural layer of nickel having the desired thickness, typically 0.1–2 mm. As a final step, the tube section 13 preferably is rinsed with deionized water, preferably at about 60° C., at a flow rate of 100–400 ml/min. for 5–20 min. to remove all residual process chemicals. Upon completion of the process, the seals 15 are deflated and the probe 10 is removed.

The electroformed layer produced according to the invention possesses an ultrafine grain microstructure wherein the grain sizes are in the range 20–5000 nm, with an average size of less than 100 nm being preferred. Further, the process can provide a high degree of crystal lattice twinning between grains, Crystal lattice structures of adjacent grains are said to be "twinned" when their crystal lattices essentially match up or align so that the adjacent grains tend to behave as one crystal structure.

The skilled person will understand that physical and chemical properties of metals are dependent on their microstructures. A relatively large metal grain size having a low degree of crystal lattice twinning of the grains generally results in brittleness and a propensity to allow crack formation which in turn provides surfaces for corrosion to set in. Alternatively, fine grain sizes with a high degree of twinning yields metals having preferred mechanical properties for heat exchanger tube applications. The invention enables the production of electroformed metal which has an ultrafine grain structure with at least 30% twinning, preferably 30–70% twinning. The electroformed metal of the invention possesses high hardness, stiffness and strength while maintaining excellent ductility. As a result, the electroformed metal according to the invention is highly resistant to corrosion as it resists the formation of micro-cracks in it.

According to the process conditions described, a structural layer of nickel may be electroformed onto the inner wall 14 of the tube section 13 in about 1–10 hrs. The process efficiency using the described platinum electrode is typically 70–100%, and generally varies within this range depending on the metal salts used and the average current density applied (i.e. a higher current density reduces efficiency).

Figure 2:
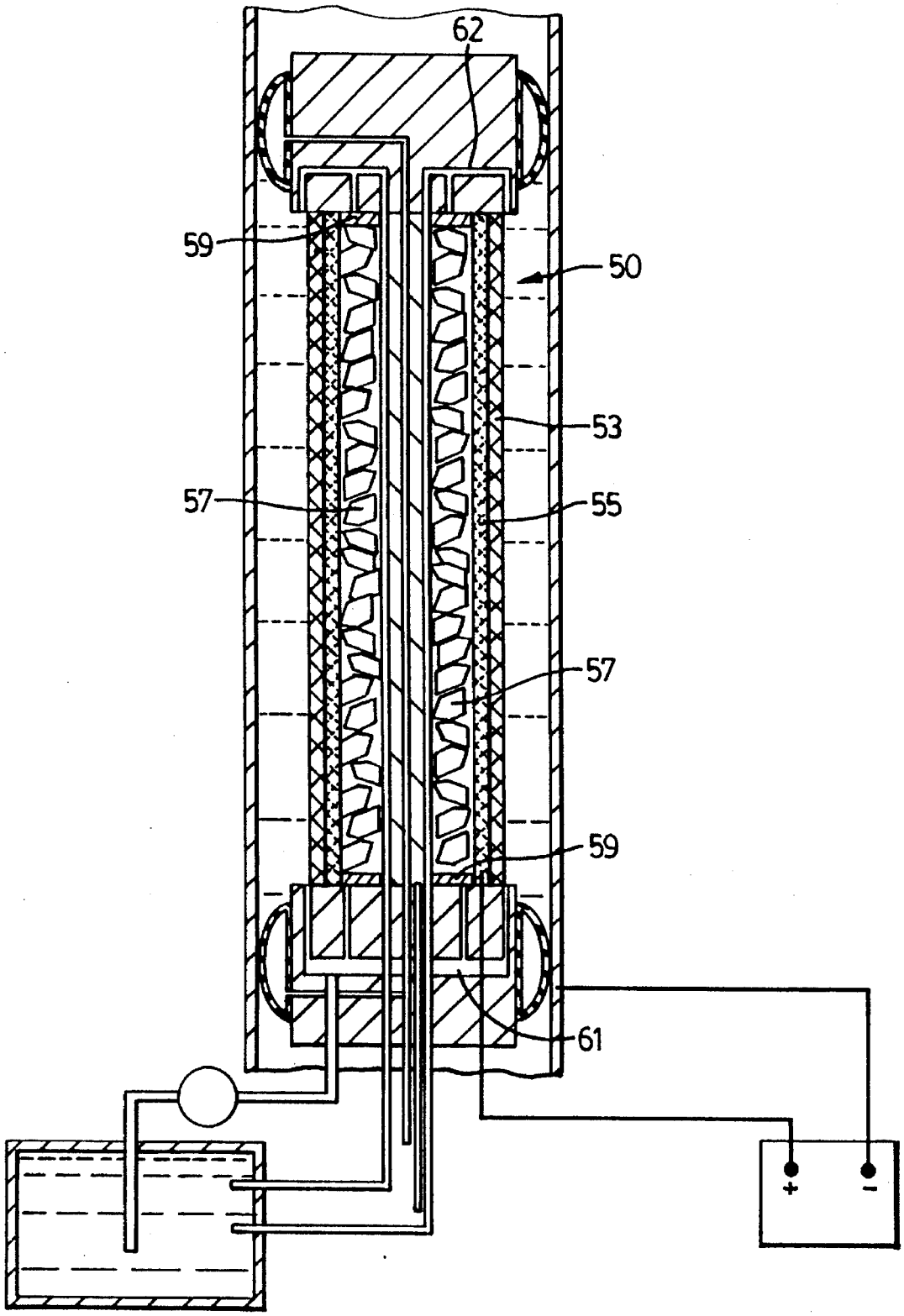
FIG. 2 is a cross sectional view of an alternative probe for performing the process.

Process efficiency can be increased to essentially 100% by using a probe 50 as shown in FIG. 2. The structure of the probe 50 is essentially the same as that of the probe 10 (FIG. 1) except that the tubular porous housing 53 and anode 55 are sized and positioned to accommodate the inclusion of pellets of pure metal (Ni) 57 within the tubular anode 55. Under electrolytic conditions, the metal from the pellets 57 ionize, thus driving the reaction kinetics toward metal deposition at the cathode (tube wall 14). As some sludge formation normally accompanies the electrolytic ionization of the metal pellets 57, filters 59 are provided at inlets 61 and outlets 62 within the anode 55.

As mentioned, the skilled person will understand that mechanical and chemical properties of a metal are related to its grain microstructure and size. Thus, small grain size of a metal correlates with greater metal strength and higher ductility (for review see Fougere et al., Scripta Metall. et Mater., 26, 1879 (1992)). A high degree of "special" grain boundaries (such as annealing twins) on the order of >30% correlates with greater resistance to stress corrosion cracking (see Palumbo et al., Scripta Metall. et Mater., 25, 1775 (1991)).

Figure 3:
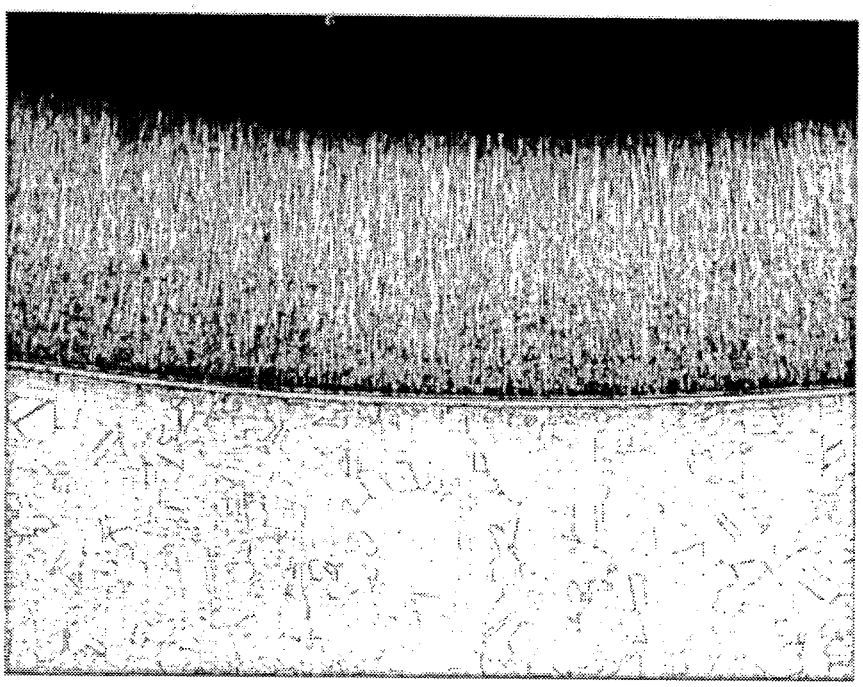
FIG. 3 is a cross sectional optical photomicrograph (100X) showing an electroformed nickel layer produced according to the invention.

FIG. 3 shows a cross sectional optical photomicrograph (100X) showing an electroformed nickel layer produced in a tube according to the process of the invention. The uniform fine grain structure of the nickel layer can be seen in FIG. 3.

Figure 4:
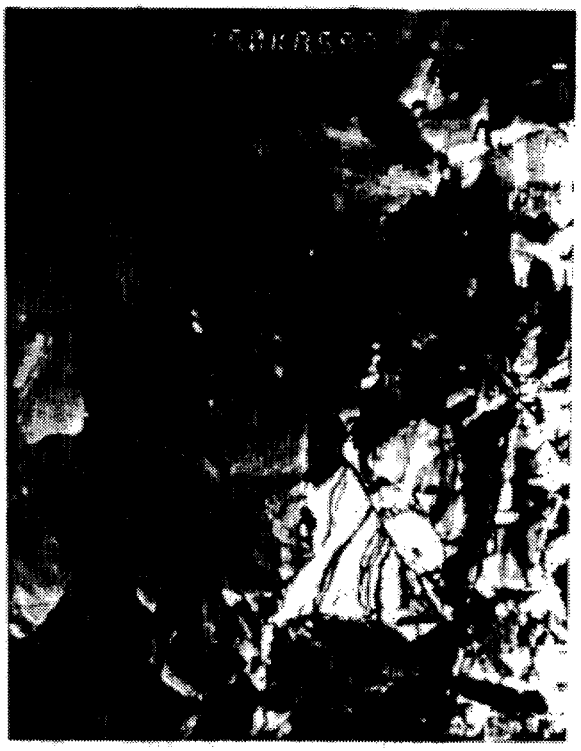
FIG. 4 is a micrograph (1500X) showing the ultra-fine grain structure and high degree of twinning for a nickel layer produced according to the invention.

The ultra-fine grain structure and high degree of twinning or "special" grain boundaries for a structural nickel layer formed by the process of the invention is apparent from the 15,000X magnification of the micrograph of FIG. 4. The ultrafine grained, highly twinned crystalline structure of a nickel layer formed by the present process provides minimum mechanical properties as follows: Vickers hardness≧200; yield strength≧80,000 psi; tensile strength≧100,000 psi; and elongation to failure in bending≧10%.

We claim:

1. A process for in situ electroforming a structural reinforcing layer of metal bonded to an internal wall of a degraded section of metal tube, comprising:

mechanically cleaning the internal tube wall surface in said tube section;

inserting a probe into the metal tube and moving it so that it spans the degraded tube section, the probe having an electrode extending substantially along its length, sealing means at each end for containment of fluids within the tube section, and circulation means for flowing fluids into and out of the tube section;

electrodepositing a strike layer of metal on the internal wall of the tube section by flowing an electrolyte containing at least one metal salt of interest through the section and applying a direct current between the electrode and the metal tube to cause the electrodeposition of a metal layer not exceeding 10 μm thick; and electroforming a structural layer of metal on the strike layer by flowing an electrolyte containing at least one metal salt of interest through the section and applying a pulsed direct current between the electrode and the metal tube at a pulse frequency of 100 to 1000 Hz with a duty cycle in the range 10 to 40% for a sufficient time to electroform a metal layer 0.1 to 2 mm thick, so that the tube section is restored to its original mechanical properties, said structural electroformed layer having an ultrafine grain microstructure which provides the layer with a high degree of hardness, stiffness and strength while maintaining excellent ductility.

2. A process as claimed in claim 1, wherein the metal tube is made of iron, copper, nickel or an alloy comprising any of iron, copper and nickel, said tube having an internal diameter of at least 10 mm; and further comprising the step of applying a pulsed direct current between the electrode and the metal tube to electrodeposit the strike layer.

3. A process as claimed in claim 2, wherein the electrode is an anode and the metal tube is a cathode during electrodeposition of metal on the internal tube wall; and further comprising the step of activating the metal surface of the internal wall of the tube section just prior to electrodeposition of the strike layer, said activating being accomplished by flowing a surface activating fluid through the tube section.

4. A process as claimed in claim 3, wherein the activating fluid is dilute aqueous strong mineral acid.

5. A process as claimed in claim 4, wherein the activating fluid is 5% aqueous HCl which is circulated through the tube section at a flow rate of 100–400 ml/min. for 5–10 min.

6. A process as claimed in claim 1, wherein the mechanical cleaning is accomplished by brushing.

7. A process as claimed in claim 1, wherein the mechanical cleaning is accomplished by water lancing.

8. A process as claimed in claim 1, further comprising the step of degreasing the internal surface of the tube section after inserting the probe.

9. A process as claimed in claim 8, wherein degreasing is accomplished by flowing an aqueous solution of 5% hydroxide through the tube section while applying a current density of 10–100 mA/cm$^2$ between the electrode (anode) and the metal tube (cathode) for 5–10 min.

10. A process as claimed in claim 9, wherein degreasing utilizes 5% aqueous NaOH at a flow rate of 100–400 ml/min.

11. A process as claimed in claim 9, further comprising the step of rinsing the tube section with deionized water after degreasing.

12. A process as claimed in claim 1, wherein the electroforming of the structural layer of metal includes periodic polarity reversals of the applied pulsed direct current, said polarity reversals being at a lower average current density than that used for electroforming and said reversals not exceeding about 10% of the total duty cycle.

13. A process as claimed in claim 3, wherein the electroformed structural layer of metal is nickel, the strike layer being electrodeposited using an electrolyte containing $NiCl_2$, the structural layer being electroformed using an electrolyte containing $NiSO_4$ or $Ni(SO_3NH_2)_2$, and electroforming is followed by rinsing with dionized water.

14. A process as claimed in claim 13, wherein the electrolyte for electrodeposition of the strike is an aqueous solution of 200–400 g/l $NiCl_2$, and the electrolyte for electroforming the structural layer is an aqueous solution of 300–450 g/l $NiSO_4$ or $Ni(SO_3NH_2)_2$.

15. A process as claimed in claim 13, wherein 30–45 g/l boric acid is added as a buffer to the electrolytes used for electrodeposition of the strike and electroforming of the structural layer.

16. A process as claimed in claim 13, wherein $NiCO_3$ is used to make up nickel cations depleted from the electrolyte during electroforming of the structural layer.

17. A process as claimed in claim 15, wherein the electrolyte for electroforming the structural layer also contains sodium lauryl sulfate, coumarin or saccharin or any combination of them each having a concentration not exceeding 1 g/l.

18. A process as claimed in claim 14, wherein the electrolyte for electrodeposition of the strike is at about 60° C., and a direct current density of 50–150 mA/cm$^2$ is applied between the anode and cathode for 2–15 min.

19. A process as claimed in claim 14, wherein the electrolyte for electrodeposition of the strike is at about 60° C. and a pulsed direct current is applied between the anode and cathode with an average current density of 50–150 mA/cm$^2$ at a frequency of 100–1000 Hz and an on-time duty cycle of 10–40% for 2–15 min.

20. A process as claimed in claim 19, wherein the electrolyte for electroforming the structural layer is at 40–60° C. and a pulsed direct current is applied between the anode and cathode with an average current density of 50–300 mA/cm$^2$ for 1–10 hrs.

21. A process as claimed in claim 20, wherein the electroforming of the structural layer includes periodic polarity reversals of the pulsed direct current, said polarity reversals being at a lower average current density than that used for electroforming and said reversals not exceeding about 10% of the total duty cycle.

22. A process as claimed in claim 13, wherein the anode comprises nickel metal which is consumable during electrodeposition and electroforming steps.

* * * * *